US009584921B2

(12) United States Patent
Shi et al.

(10) Patent No.: US 9,584,921 B2
(45) Date of Patent: Feb. 28, 2017

(54) SOUND TRANSDUCER

(71) Applicant: Nokia Corporation, Espoo (FI)

(72) Inventors: Shengrong Shi, San Diego, CA (US); Yuanjia Yang, Beijing (CN); Jian Guo, San Diego, CA (US); Oscar Lopez, San Diego, CA (US)

(73) Assignee: Nokia Technologies Oy, Espoo (FI)

( * ) Notice: Subject to any disclaimer, the term of this patent is extended or adjusted under 35 U.S.C. 154(b) by 12 days.

(21) Appl. No.: 14/331,655

(22) Filed: Jul. 15, 2014

(65) Prior Publication Data

US 2016/0021460 A1 Jan. 21, 2016

(51) Int. Cl.
*H04R 9/02* (2006.01)
*H04R 9/06* (2006.01)

(52) U.S. Cl.
CPC ..... *H04R 9/025* (2013.01); *H04R 9/06* (2013.01); *H04R 2400/11* (2013.01); *H04R 2499/11* (2013.01)

(58) Field of Classification Search
CPC ..... H04R 9/00; H04R 9/025; H04R 9/027; H04R 2400/11; H04R 2201/02
USPC ..... 381/396, 398, 412, 414, 417, 420
See application file for complete search history.

(56) References Cited

U.S. PATENT DOCUMENTS

| | | | | |
|---|---|---|---|---|
| 2,532,413 | A | 12/1950 | Levy | 179/117 |
| 3,319,201 | A * | 5/1967 | Coen | H04R 9/025 381/420 |
| 3,550,051 | A * | 12/1970 | Parker | H01F 7/0289 381/420 |
| 8,315,421 | B2 | 11/2012 | Mihelich et al. | 381/412 |
| 2010/0220889 | A1* | 9/2010 | Adelman | H04R 11/02 381/412 |
| 2011/0293121 | A1 | 12/2011 | Yan | 381/191 |
| 2013/0016874 | A1 | 1/2013 | Huang et al. | 381/433 |
| 2014/0056464 | A1* | 2/2014 | Li | H04R 9/025 381/400 |
| 2015/0110336 | A1* | 4/2015 | Song | H04R 1/025 381/412 |
| 2015/0181345 | A1* | 6/2015 | Cai | H04R 9/06 381/412 |
| 2015/0304776 | A1* | 10/2015 | Backman | H04R 1/00 381/398 |

FOREIGN PATENT DOCUMENTS

| | | | |
|---|---|---|---|
| EP | 2131606 | A2 | 12/2009 |
| WO | WO-2011125804 | A1 | 10/2011 |

* cited by examiner

*Primary Examiner* — Suhan Ni
(74) *Attorney, Agent, or Firm* — Harrington & Smith

(57) ABSTRACT

An apparatus including a frame; a coil movably connected to the frame; and a magnet system connected to the frame. The magnet system includes at least one magnet and at least one pole piece connected to the at least one magnet. The at least one pole piece include a magnet pot. A cross sectional length of the magnet pot and the frame are substantially the same in at least one cross sectional location.

19 Claims, 8 Drawing Sheets

SOUND TRANSDUCER

BACKGROUND

Technical Field

The exemplary and non-limiting embodiments relate generally to a magnet system and, more particularly, to a magnet system for use with a coil.

BRIEF DESCRIPTION OF PRIOR DEVELOPMENTS

A speaker generally has a frame, a magnet system, a coil and a diaphragm. The magnet system is connected to the frame. The diaphragm is connected to the frame and the coil. The coil is selectively energized to move the diaphragm relative to the frame and the magnet system.

SUMMARY

The following summary is merely intended to be exemplary. The summary is not intended to limit the scope of the claims.

In accordance with one aspect, an example embodiment is provided in an apparatus comprising a frame; a coil movably located in the apparatus; and a magnet system connected to the frame, where the magnet system comprises at least one magnet and at least one pole piece connected to the at least one magnet, where the at least one pole piece comprises a magnet pot, and where a cross sectional length of the magnet pot and the frame are substantially the same in at least one cross sectional location.

In accordance with another aspect, an example method is provided comprising providing a magnet pot; and connecting a frame with the magnet pot, where the frame and the magnet pot have a substantially same cross sectional length in at least one cross sectional location.

In accordance with another aspect, an example embodiment is provided in an apparatus comprising a frame; and a magnet pot connected to the frame by a connection, where the frame is located both inside the magnet pot and outside the magnet pot for the connection to be an interlocking connection of the frame with the magnet pot.

In accordance with another aspect, an example method is provided comprising providing a magnet pot, where the magnet pot comprises an internal receiving area; and insert molding a frame onto the magnet pot, where the frame is located at an exterior of the magnet pot and inside the internal receiving area to interlock the frame with the magnet pot.

BRIEF DESCRIPTION OF THE DRAWINGS

The foregoing aspects and other features are explained in the following description, taken in connection with the accompanying drawings, wherein.

DETAILED DESCRIPTION OF EMBODIMENTS

Figure 1:
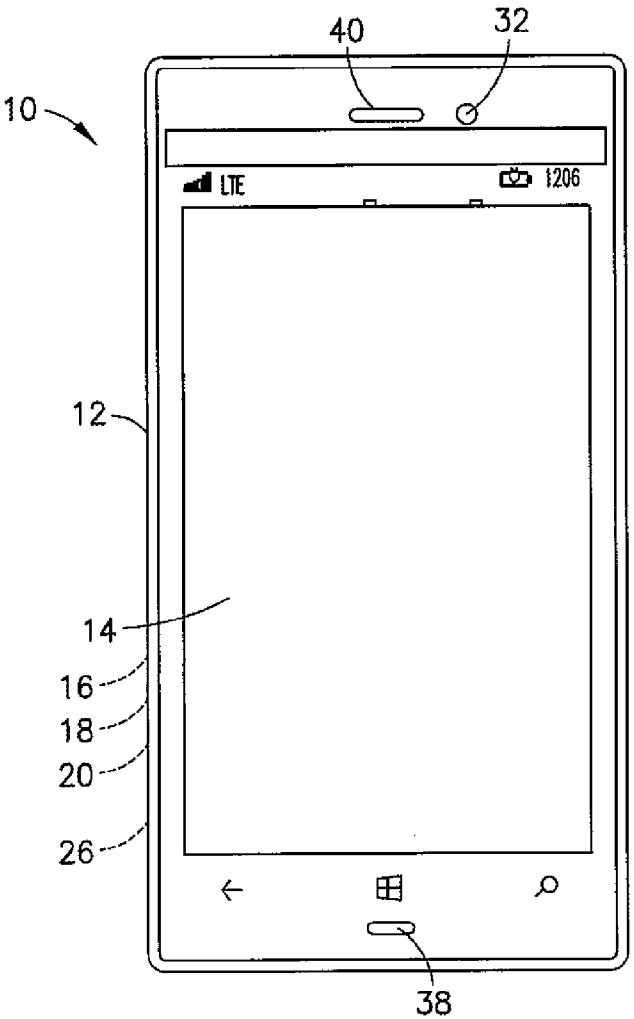
FIG. 1 is a front view of an example embodiment of an apparatus comprising features as described herein.

Referring to FIG. 1, there is shown a front view of an apparatus 10 incorporating features of an example embodiment. Although the features will be described with reference to the example embodiments shown in the drawings, it should be understood that features can be embodied in many alternate forms of embodiments. In addition, any suitable size, shape or type of elements or materials could be used.

The apparatus 10 may be a hand-held portable apparatus, such as a communications device which includes a telephone application for example. In the example shown the apparatus 10 is a smartphone which includes a camera and a camera application. The apparatus 10 may additionally or alternatively comprise an Internet browser application, a video recorder application, a music player and recorder application, an email application, a navigation application, a gaming application, and/or any other suitable electronic device application. In an alternate example embodiment the apparatus might not be a smartphone. For example, the apparatus might be a tablet computer, or a hand-held gaming device, or a handset control; any device having a speaker or loudspeaker.

Figure 2:
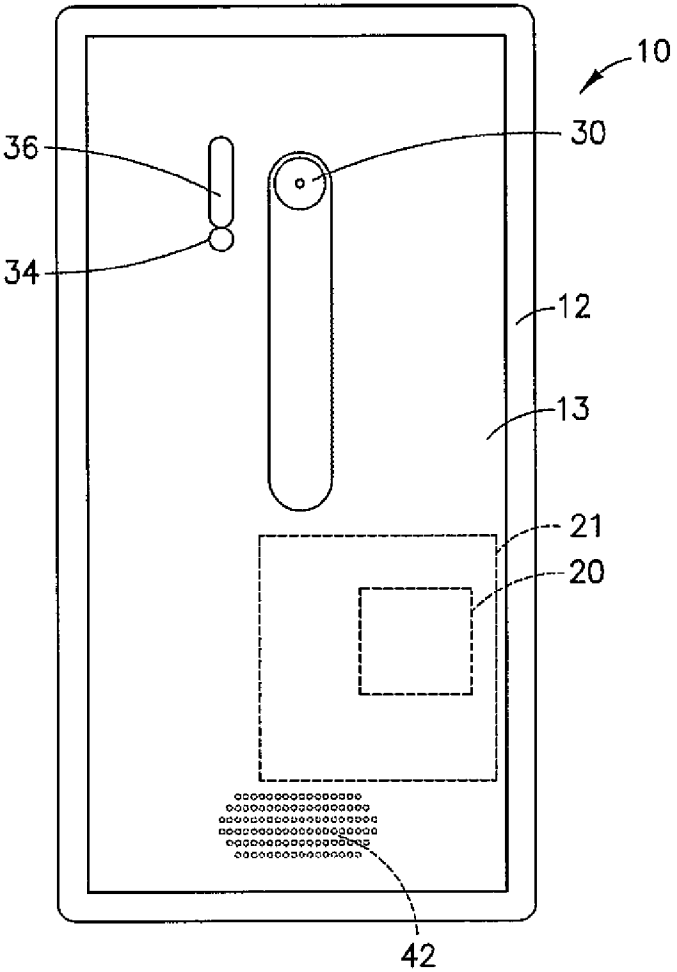
FIG. 2 is a rear view of the apparatus shown in FIG. 1.
Figure 3:
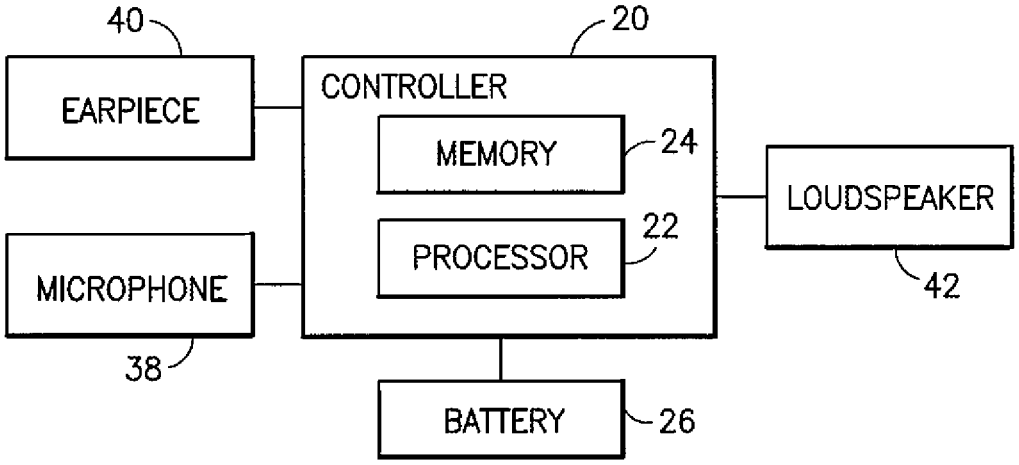
FIG. 3 is a diagram illustrating some of the components of the apparatus shown in FIG. 1.

Referring also to FIGS. 2-3, the apparatus 10, in this example embodiment, comprises a housing 12, a touchscreen 14, a receiver 16, a transmitter 18, a controller 20, a rechargeable battery 26 and a camera 30. However, all of these features are not necessary to implement the features described below. The controller 20 may include at least one processor 22, at least one memory 24, and software 28. The electronic circuitry inside the housing 12 may comprise at least one printed wiring board (PWB) 21 having components such as the controller 20 thereon. The receiver 16 and transmitter form a primary communications system to allow the apparatus 10 to communicate with a wireless telephone system, such as a mobile telephone base station for example.

In this example, the apparatus 10 includes the camera 30 which is located at the rear side 13 of the apparatus, a front camera 32, an LED 34, and a flash system 36. The LED 34 and the flash system 36 are also visible at the rear side of the apparatus, and are provided for the camera 30. The cameras 30, 32, the LED and the flash system 36 are connected to the controller 20 such that the controller 20 may control their operation. In an alternate example embodiment the rear side may comprise more than one camera, and/or the front side could comprise more than one camera. The apparatus 10 includes a sound transducer provided as a microphone 38. In an alternate example the apparatus may comprise more than one microphone. The apparatus 10 includes a sound transducer provided as an earpiece 40, and a sound transducer provided as a speaker 42. More or less than one speaker may be provided.

Referring also to FIGS. 4-8, the loudspeaker 42 is a sound transducer as noted above. The sound transducer 42 includes a magnet system 43, a coil 44, and a diaphragm 45 connected to the coil 44. The magnet system 43 comprises a permanent magnet 46 and two pole pieces 48, 49. In an alternate embodiment the magnet could be an electromagnet. In an alternate example more than one permanent magnet and more than two pole pieces could be provided. In the example shown the diaphragm 45 has its outer perimeter connected to a frame 50 with a front cover 51. The assembly 42 may be mounted to a chassis or frame piece of the apparatus 10. The magnet 46 and pole pieces 48, 49 form an area 54 for the coil 44 to move in.

A pole piece is a structure composed of material of high magnetic permeability that serves to direct the magnetic field produced by a magnet. A pole piece attaches to and, in a sense, extends a pole of the magnet; hence the name. Magnetic flux will travel along the path that offers it the least amount of resistance, (or, more accurately, the least amount of reluctance). Steel components in a magnetic circuit offer the flux a low reluctance path. This fact allows the use of steel pole pieces to capture flux and concentrate it, (or merely redirect it), to the point of interest.

Focusing of flux can be achieved by tapering the steel. However, one must be aware that as the pole area of the steel pole piece decreases, the flux density within the steel will increase (if the total flux traveling through the steel component remains constant). Steel pole pieces can also be used to homogenize the field over the active volume.

Pole pieces are desired because magnets are hard to make into complex shapes which may be needed and, thus, expensive. Pole pieces are used with both permanent magnets and electromagnets. In the case of an electromagnet, the pole piece or pieces simply extend the magnetic core and can even be regarded as part of it, particularly if they are made of the same material. The traditional material for pole pieces was p-metal like soft iron. While still often used with permanent magnets, soft iron suffers from eddy currents which make it less suitable for use with electromagnets, and particularly inefficient when the magnet is excited by alternating current. Pole pieces take many shapes and forms depending on the application. A traditional dynamic loudspeaker has a distinctive annular magnet and pole piece structure which serves to concentrate the magnetic flux on the coil.

For the loudspeaker 42, when the electrical current flowing through the coil 44 changes direction, the coil's polar orientation reverses. This changes the magnetic forces between the coil 44 and the permanent magnet/pole pieces 46, 48, 49, moving the coil 44 and attached diaphragm 45 back and forth in the gap 54.

The electromagnet formed by the coil 44 is positioned in a constant magnetic field created by the permanent magnet 46 and the pole pieces 48, 49. The electromagnet and the permanent magnet interact with each other as any two magnets do. The positive end of the electromagnet is attracted to the negative pole of the permanent magnetic fields, and the negative pole of the electromagnet is repelled by the permanent magnets' negative poles. When the electromagnet's polar orientation switches, so does the direction of repulsion and attraction. In this way, the alternating current constantly reverses the magnetic forces between the coil and the permanent magnets. This pushes the coil 44 back and forth rapidly, like a piston.

When the coil 44 moves, it pushes and pulls on the diaphragm 45. This vibrates the air in front of the diaphragm, creating sound waves. The electrical audio signal can also be interpreted as a wave. The frequency and amplitude of this wave, which represents the original sound wave, dictates the rate and distance that the coil moves. This, in turn, determines the frequency and amplitude of the sound waves produced by the diaphragm.

Features as described herein may be used to introduce an improved structure providing better power handling capacity, sensitivity and robustness under the same size as a conventional micro-speaker. As consumer electronics become more and more popular, requirements for micro-speakers used in consumer electronics, such as a smart phone, tablet computer, etc., are also more and more demanding. Louder sensitivity and high power handling capacity are attractive points. Conventional speaker structures will, more and more, become a bottle neck to increase sensitivity and power handling capacity.

A traditional micro-speaker structure is composed by a plastic frame and a traditional magnetic system. The traditional magnet system is composed by a magnet, a magnet pot, a top plate, a coil, a membrane, a front cover and contact leaf springs. The magnetic system is assembled into the frame usually by glue at junctions. In this kind of structure, the frame will limit the metal area exposed to the air; which is normally the main cooling part of the whole speaker. Taking a 13×18 mm speaker for example, the size of cooling area is usually around 13×8 mm. Also, the glue between the plastic frame and magnetic system can move when too much force is applied; leading to a reliability problem after tumbling or free fall of the apparatus, such as when a smart phone is dropped for example. As an alternative to the use of glue or adhesive, or as an addition to the use of glue/adhesive, other techniques may be used to connect the plastic frame with the magnetic system. However, the assembly comprising the plastic frame and magnet system may still be deformed when excessive force is applied. Also, the traditional magnetic system does not have too much space to improve the BL value.

Features as described herein may be used for a new micro-speaker structure design where there is provided flexible radius optimization of a magnet pot during design, and a new connection of a plastic frame with the magnet pot. This may be used to provide an improved sensitivity with BL optimization, an improved power handling capacity with enlarged heat cooling area, and good reliability with new connection method between magnet pot and plastic frame.

BL is determined by the flux density (B) in the magnetic gap 54 and the length of coil wire in the gap. A higher BL will generally mean a speaker will have a higher relative sensitivity (efficiency). This does not necessarily mean that all speakers with a higher BL will produce a higher Sound Pressure Level (SPL). Often speakers with very high BLs have a smaller Xmax (Xmax=coil length minus the gap height).

In an example embodiment, taking a 13×18 mm micro speaker for example, use of features as described herein may provide the speaker a 200~300 percent larger metal heat cooling area than a conventional design, which provides more power handling capacity. Also, the flux density (B) value may be 22 percent higher than a conventional design having the same magnet size, same top plat and same magnetic gap. It can increase the sensitivity about 1.7 dB by average for example. It can also improve the reliability of the speaker especially in junction part of magnetic system and plastic basket.

Referring to the Figures, the magnet system 43 has its first pole piece 48 provided as a magnet pot. The magnet pot is larger compared to conventional magnet pot having a same size frame and magnet. The magnet pot 48 has a base 56 and four sides 58*a*, 58*b*, 59*a*, 59*b* which extend from the base 56. In the example shown, the sides 58-59 each bend about 180 degrees. However, in alternate examples more or less than four sides could be bent more than 90 degrees.

With this design, the magnet pot 48 may be substantially as big as the outline or footprint F of a conventional plastic frame. Taking a 13×18 mm speaker as an example, the metal area of the magnet pot 48 exposed to air as a cooling part may be increased to 228 $mm^2$. This is 220 percent of a conventional design; an increase of 120 percent.

According to Fourier's Law:

$$\frac{\partial Q}{\partial t} = -k \oint_s \vec{\nabla} T \cdot \overrightarrow{dA}.$$

The temperature gradient is more or less the same because of the same material. The larger total surface, the more heat can conducted to air. Compared with a conventional micro-speaker design, the new structure has a much bigger area exposed to air; which can conduct much more heat. That means, in given time t, for the conventional design, suppose:

Q1 is the heat can keep the coil to 120 Celsius degree,

Q2 is the heat escaped from coil and membrane,

Q3 is the heat escaped from magnetic system.

Q4 is the energy transferred to sound.

The total power will be (Q1+Q2+Q3+Q4)/t.

The new structure is roughly (Q1+Q2+2*Q3+Q4)/t. So this design can increase the Power Handling Capacity (PHC) by Q3/t.

Since the metal magnet pot occupies most of the area at the bottom side of the frame 50, a pair of coil springs 60 may be used for the electrical lead connection of the coil leads 62 instead of conventional leaf springs.

Figure 9:
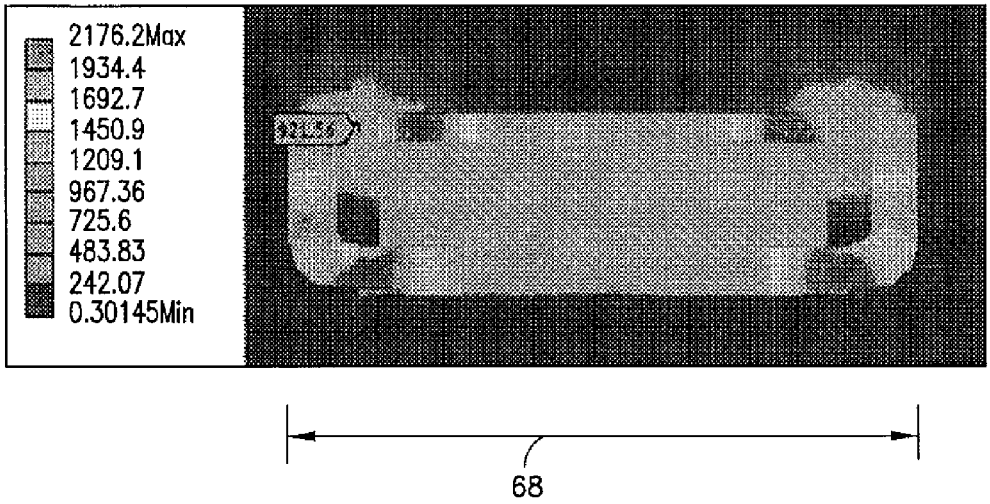
FIG.9 PRIOR ART
FIG. 9 is a result from a simulation regarding a conventional magnet pot.
Figure 10:
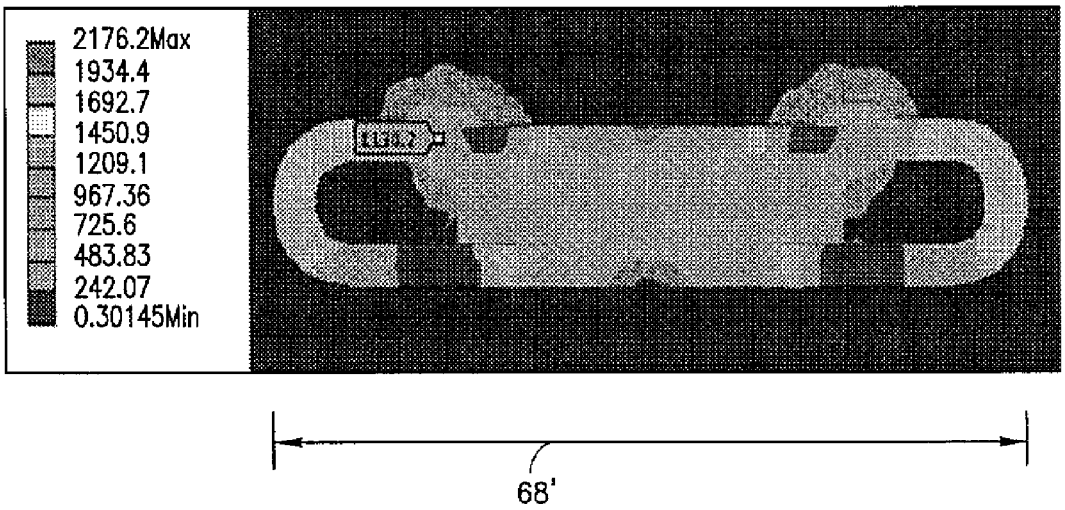
FIG. 10 is a result from a simulation similar to FIG. 9 of the magnet pot shown in FIG. 4-8.

The new pot design will also improve the magnetic field strength under the magnetic gap 54 as compared to a convention design having the same size magnetic gap. The BL value is mainly improved by the radius optimization of the magnet pot. The traditional design has a very small radius which will lead to a great loss. In the new structure 48, the radius of the bend at the sides 58-59 may be designed very smooth; which can help the B value reduce more slowly. With this change, the BL value is roughly 22 percent higher in average using ANSYS simulation results based on an example 3D model; same top plate and same magnetic gap based on different positions. By average, it can increase the sensitivity about 1.7 dB with the same voice-membrane system. Results of an ANSYS simulation for a conventional design is shown in FIG. 9, and results for a design using the magnet pot 48 is shown in FIG. 10. The cross sectional length 68' of the new magnet pot 48 is larger than the cross sectional length 68 of the conventional magnet pot having a same size footprint plastic frame.

With the new magnet pot design, the assembly of the frame to the magnet pot may comprises use of insert-metal injection or insert molding instead of using merely glue. This type of assembly method will provide a more robust connection between the magnet pot 48 and the plastic frame 50 because the frame may be integrally molded onto the magnet pot 48. Because the sides 58-59 each have a bend of more than 90 degrees, each side 58-59 forms an interior facing recess 64. These recesses 64 are filled, at least partially, with material of the frame 50 at 66. Material of the frame 50 is also located at the outside of the sides 58-59. The location of the material of the frame 50 both inside and outside the magnet pot 48 stationarily interlocks the frame 50 onto the magnet pot 48.

The total assembly sequence may also be changed due to plastic injection tooling. Conventionally, the traditional way is to make the magnet pot, magnet and top plate into a sub-assembly first, and then assemble the sub-assembly to plastic frame, such as by gluing the magnet pot inside a receiving aperture of the plastic frame. With injection molding of the frame onto the magnet pot, on the other hand, the new magnet pot 48 may be located in the injection mold and then the frame is injection molded in the mold; the magnet pot becomes part of the plastic mold tooling. The magnet and top plate may be assembled onto the metal pot 48 after the plastic frame 50 has been formed into the magnet pot.

Figure 11:
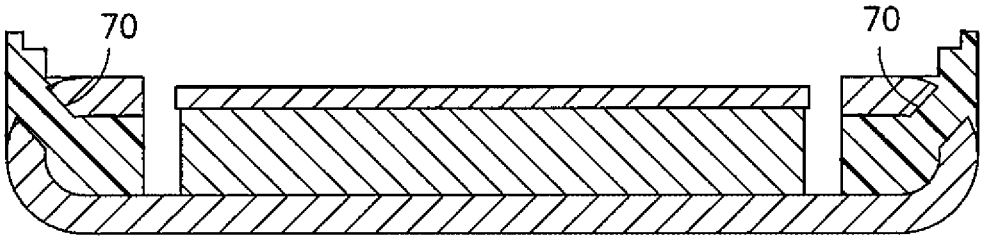
FIG. 11 is a cross sectional view of an alternate embodiment.

The junction strength between a magnet pot and a plastic frame of traditional micro-speaker structure depends on glue; which is always relatively weak in shear force. In a traditional design, the plastic frame is the holder and the magnetic system is assembled into the holder as a sub-assembly by a perimeter glue attachment inside of a through-hole in the holder. The connection allows almost no force to be applied to the magnet pot in traditional design; otherwise the sub-assembly may become axially offset from the plastic holder. In the new structure as shown by the example in FIGS. 4-8, the magnetic system 43 becomes the holder of the plastic frame 50. Any force which does not exceed the limit to the front cover 51 can be applied. There is no glue needed between the magnet pot and the plastic frame because of the insert-metal injection process of formation/connection. The junction strength depends on the strength of the plastic which forms the frame 50; which is much higher than glue. Optionally, through-holes 70 can be designed on the magnet pot to have the plastic extend through the side walls to enhance the reliability as illustrated by the example shown in FIG. 11.

Figure 12:
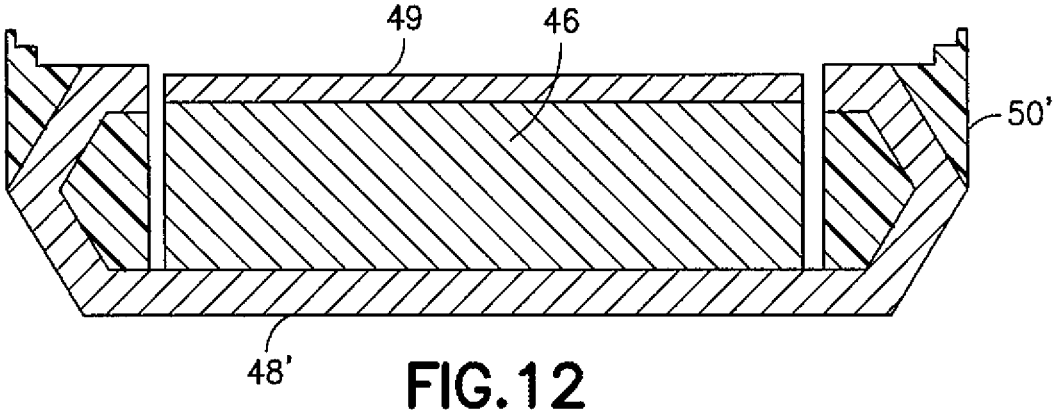
FIG. 12 is a cross sectional view of an alternate embodiment.
Figure 13:
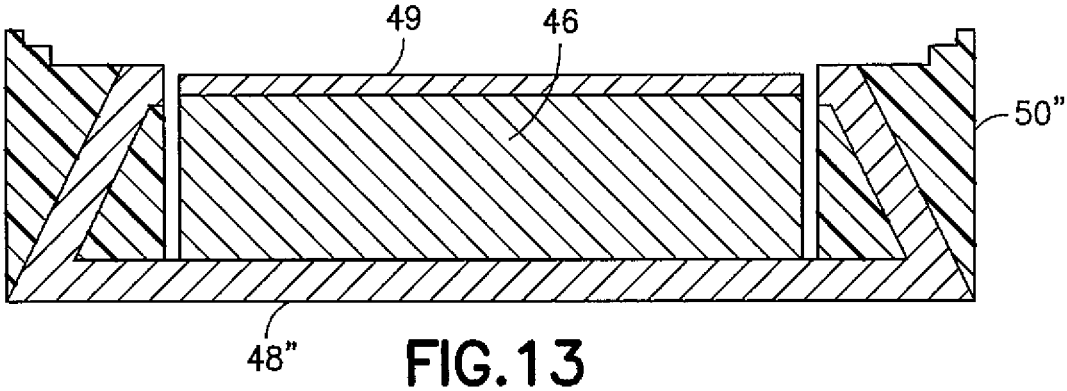
FIG. 13 is a cross sectional view of an alternate embodiment.

The magnetic gap of new structure may be the same as traditional design in X, Y direction. However, this is not necessary. The size of the gap 54 may be larger or smaller. The centre of the pole plate 49 and bended magnetic pot 48 may be aligned to a same surface in a Z-direction to maximize the BL value, also it can be slightly offset to improve symmetry of B field. For X, Y boundary, it may depend on how to optimize the magnet pot radius of the bent side walls to get the maximum BL value. It is not necessary the same value as described above. An example of 13×18 mm is used above. However, this is merely an example and should not be considered as limiting. Features as described herein may be used with small, larger or otherwise different sizes. It can be smaller, with even higher sensitivity with a well optimized radius at the side walls of the magnet pot. The bend may sometimes not be a radius. It could be sliding surface; depending on how to optimize the B value of magnetic field. Usually, the bigger, smoother radius will help to increase the BL value. FIGS. 12-13 show examples of magnet pots 48', 48" having different shape side walls and the respective integrally molded plastic frames 50', 50" on those side walls.

Figure 14:
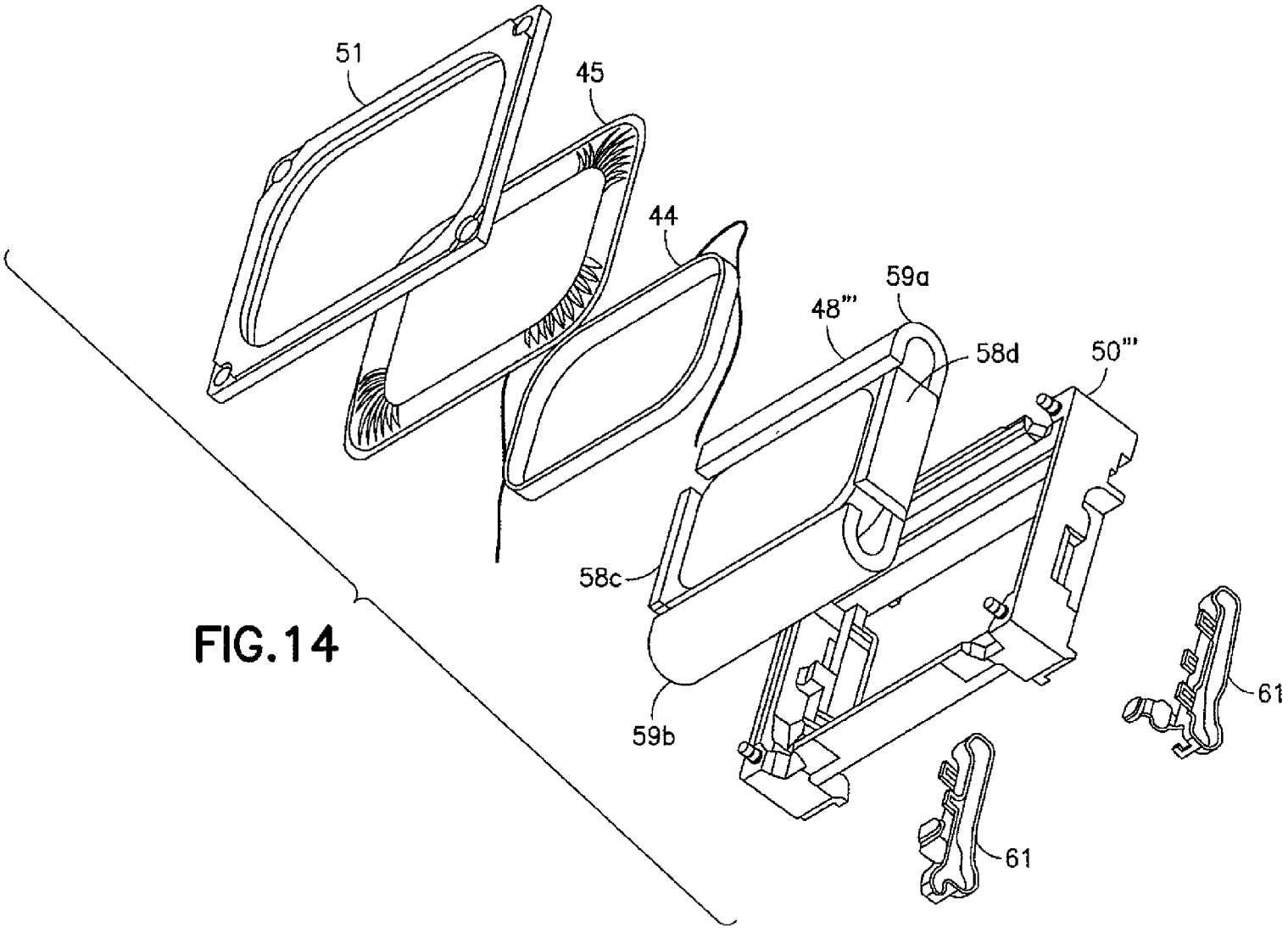
FIG. 14 is an exploded perspective view of an alternate embodiment.

Another example embodiment is shown in FIG. 14. In this embodiment only two of the side walls 59*a*, 59*b* of the magnet pot 48''' are bend more than 90 degrees. The other two side walls 58*c*, 58*d* are bent only 90 degrees; similar to a conventional magnet pot side wall. It may have less cooling area and BL value than the embodiment shown in FIGS. 4-8, but it is still better than a traditional structure. This hybrid design is especially suitable for a current earpiece such as 6×15 mm since they have much longer sides than short sides. This design can use the conventional leaf spring contacts 61 connected to the frame 50''' at the lateral side of the side walls 58*c*, 58*d*.

Features as described herein may be used to provide a new structure having an improved BL value, larger cooling area and stronger robustness. Features as described herein may be used to provide a new structure which can accommodate any force 100 on the magnet pot with no displacement between the plastic frame and magnet pot (see FIG. 6).

Figure 15:
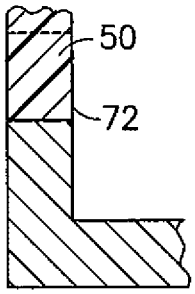
FIG. 15 is a partial cross sectional view of an alternate embodiment.
Figure 16:
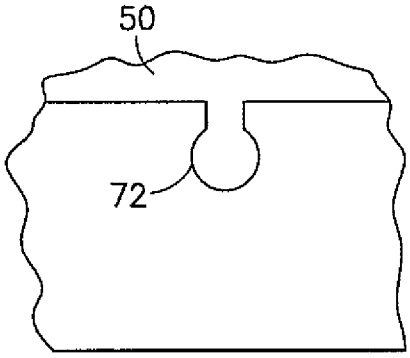
FIG. 16 is a side view of the embodiment shown in FIG. 15.
Figure 17:
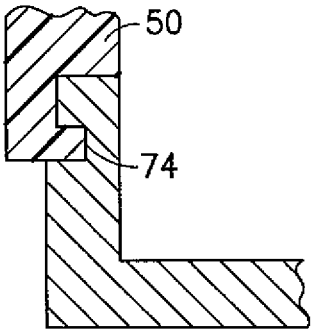
FIG. 17 is a partial cross sectional view of an alternate embodiment.
Figure 18:
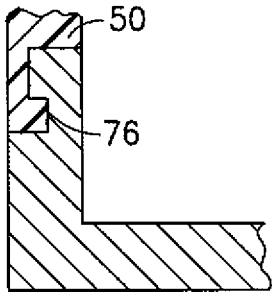
FIG. 18 is a partial cross sectional view of an alternate embodiment.

Referring also to FIGS. 15-16 another embodiment illustrating an insert molded connection is shown. In this example the frame 50 is molded into ah interlock pocket 72 in the magnet pot. Referring also to FIG. 17, another embodiment illustrating an insert molded connection is shown. In this example the exterior side of the side wall of the magnet pot has a receiving area 74 which the frame is molded into. Referring also to FIG. 18, another embodiment illustrating an insert molded connection is shown. In this example the exterior side of the side wall of the magnet pot has a different shape receiving area 76 which the frame is molded into. These are merely some examples. Other alternate examples could have other shape and size interlocking connections.

In one type of example embodiment an apparatus may comprise a frame; a coil movably connected to the frame; and a magnet system connected to the frame, where the magnet system comprises at least one magnet and pole pieces connected to the magnet, where the pole pieces comprise a magnet pot, and where a cross sectional length of the magnet pot and the frame are substantially the same in at least one cross sectional location.

The coil may be movably indirectly connected to the frame by the diaphragm. The coil and membrane assembly are configured to generate sound. If the membrane is connected to the plastic frame, the coil may stay underneath of the membrane and not be directly connected to the plastic frame. The coil is attached to the membrane so that it can move the membrane to generate sound based on the combination interaction of the permanent magnet and the generated magnetic field. The frame may be connected to the magnet pot by an insert mold formation of the frame onto the magnet pot. Thus, with the insert mold formation of the frame onto the magnet pot, the frame and the magnet pot may be designed as a single part; integrally forming one member onto another member. The magnet pot and the frame may comprise substantially same cross sectional lengths in at least two orthogonal cross sectional locations. At least two sides of the magnet pot may have a bend of more than 90 degrees. At least two sides of the magnet pot may have a recess and where a portion of the frame is located in the recess to interlock the frame with the magnet pot. At least two sides of the magnet pot may have an aperture therein, where the frame extends through the aperture to interlock the frame with the magnet pot. The longest dimension of the magnet pot, parallel to the membrane, may be at least the same or longer than the longest dimension of the membrane. In some embodiments, it is clear that the magnet pot is longer than the membrane in X and Y directions based on the transducer cross section. The height of the magnet pot may also be substantially the same height of the magnet. The total surface of the pot may be extended in all X, Y, Z directions according to the new transducer.

An example method may comprise providing a magnet pot; and connecting a frame with the magnet pot, where the frame and the magnet pot have a substantially same cross sectional length in at least one cross sectional location. Connecting the frame to the magnet pot may comprise insert molding the frame onto the magnet pot. Connecting the frame to the magnet pot may comprise locating a portion of the frame inside a receiving area of the magnet pot to form an interlock connection of the frame on the magnet pot. Connecting the frame to the magnet pot may comprise inserting a portion of the frame through an aperture through at least two side of the magnet pot. Providing the magnet pot may comprise providing the magnet pot with at least two sides having inward bends of more than 90 degrees. Connecting the frame with the magnet pot may provide at least two orthogonal cross sectional locations where the frame and the magnet pot have a respective substantially same cross sectional length at the at least two orthogonal cross sectional locations.

An example embodiment may be provided in an apparatus comprising a frame; and a magnet pot connected to the frame by a connection, where the frame is located both inside the magnet pot and outside the magnet pot for the connection to be an interlocking connection of the frame with the magnet pot.

In one type of example embodiment, a cross sectional length of the magnet pot and the frame may be substantially the same in at least one cross sectional location. However, in alternate example embodiments the cross sectional length of the magnet pot and the frame may not be substantially the same in at least one cross sectional location. The frame may be larger or smaller relative to the magnet pot, such as if needed by the diaphragm size for example. Also, based on radius optimization, the magnet pot may be shorter than the frame in cross section. The frame may be connected to the magnet pot by an insert mold formation of the frame onto the magnet pot. The magnet pot and the frame may comprise substantially same cross sectional lengths in at least two orthogonal cross sectional locations. At least two sides of the magnet pot may have a bend of more than 90 degrees. At least two sides of the magnet pot may have an aperture therein, where the frame extends through the aperture to interlock the frame with the magnet pot.

An example method may comprise providing a magnet pot, where the magnet pot comprises an internal receiving area; and insert molding a frame onto the magnet pot, where the frame is located at an exterior of the magnet pot and inside the internal receiving area to interlock the frame with the magnet pot.

An example embodiment may be provided in an apparatus comprising a frame; a magnet pot; and means for connecting the frame to the magnet pot comprising the frame being insert molded onto the magnet pot to provide an interlocking connection of the frame with the magnet pot.

In one example embodiment, the longest dimension of the magnet pot, in parallel to the membrane, is at least the same or longer than the longest dimension of the membrane/diaphragm. In some embodiments, the magnet pot is longer than the membrane in both X and Y directions based on the transducer cross section. The height of the magnet pot may also be extended towards substantially the same height of the magnet. Compared to a conventional magnet pot, the total surface of the pot may be extended in all directions X, Y, Z.

Figure 19:
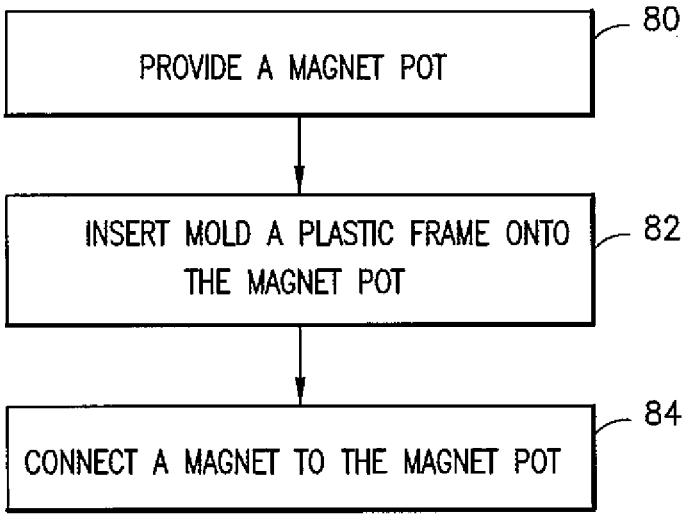
FIG. 19 is a diagram illustrating an example method.
Figure 4:
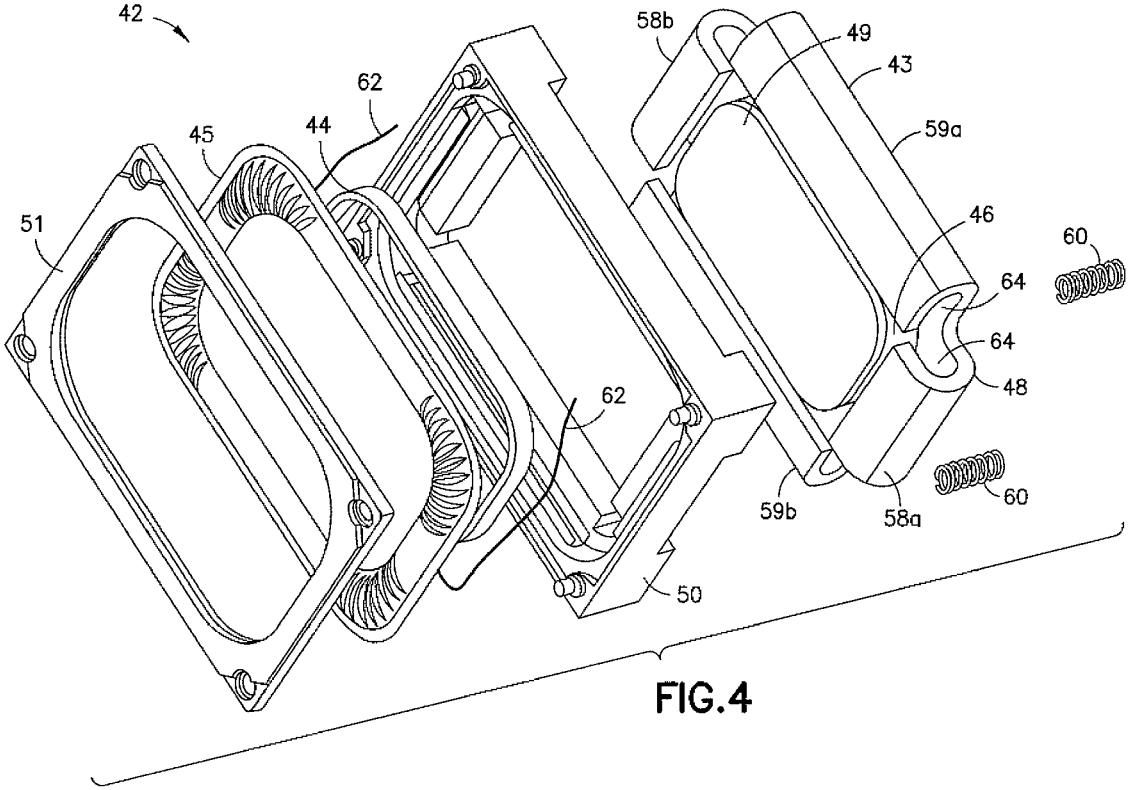
FIG. 4 is an exploded top perspective view of the loudspeaker of the apparatus shown in FIGS. 1-3.
Figure 5:
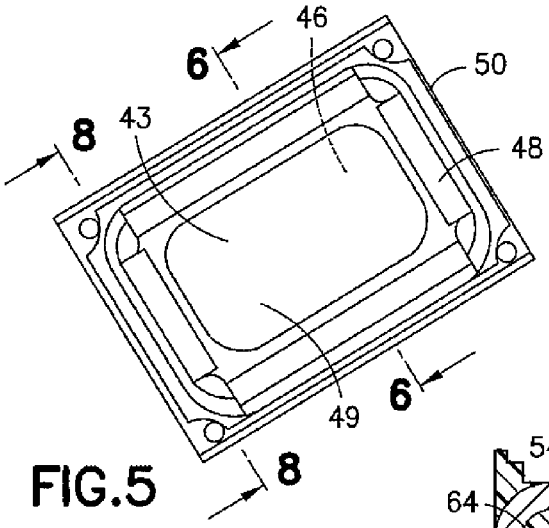
FIG. 5 is a top plan view of the magnet system and frame shown in FIG. 4.
Figure 6:
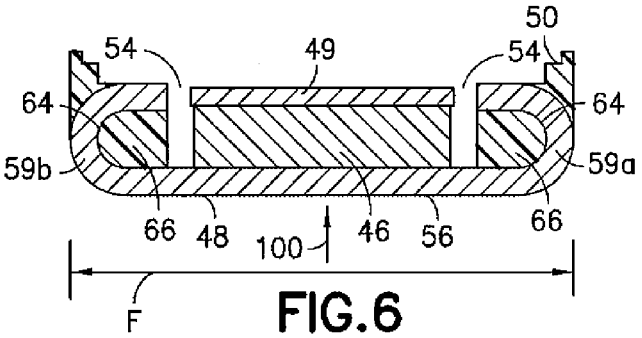
FIG. 6 is a cross sectional view taken along line 6-6 in FIG. 5.
Figure 7:
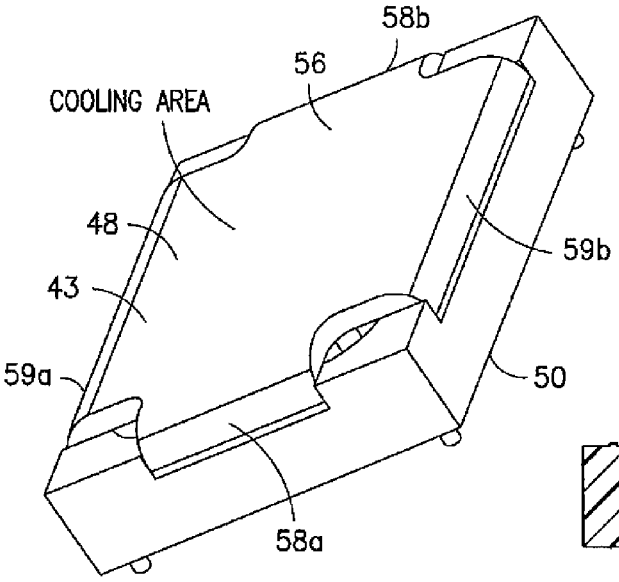
FIG. 7 is a bottom perspective view of the magnet system and frame shown in FIG. 5.
Figure 8:
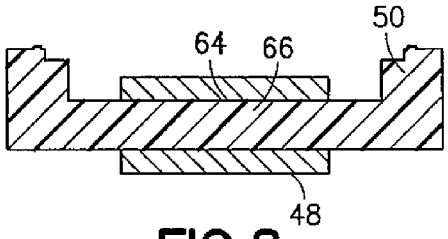
FIG. 8 is a cross sectional view taken along line 8-8 in FIG. 5.

Referring also to FIG. 19, an example method may comprise providing a magnet pot as indicated by block 80, insert molding a plastic frame onto the magnet pot as indicated by block 82, and then connecting a magnet to the magnet pot as indicated by block 84.

It should be understood that the foregoing description is only illustrative. Various alternatives and modifications can be devised by those skilled in the art. For example, features recited in the various dependent claims could be combined with each other in any suitable combination(s). In addition, features from different embodiments described above could be selectively combined into a new embodiment. Accordingly, the description is intended to embrace all such alternatives, modifications and variances which fall within the scope of the appended claims.

What is claimed is:

1. An apparatus comprising:

a frame;

a coil movably located in the apparatus; and a magnet system connected to the frame, where the magnet system comprises at least one magnet and at least one pole piece connected to the at least one magnet, where a first one of the at least one pole piece comprises a magnet pot, where a cross sectional length of the magnet pot and the frame are substantially the same in at least one cross sectional location, and where the frame is located against exterior lateral sides of at least a portion of the first pole piece.

2. An apparatus as in claim 1 where the frame is connected to the magnet pot by an insert mold formation of the frame onto the magnet pot.

3. An apparatus as in claim 1 where the magnet pot and the frame comprise substantially same cross sectional lengths in at least two orthogonal cross sectional locations.

4. An apparatus as in claim 1 where at least two sides of the magnet pot have a bend of more than 90 degrees.

5. An apparatus as in claim 1 where at least two sides of the magnet pot have a recess and where a portion of the frame is located in the recess to interlock the frame with the magnet pot.

6. An apparatus as in claim 1 where at least two sides of the magnet pot has an aperture therein, and where the frame extends through the aperture to interlock the frame with the magnet pot.

7. A device comprising:

an apparatus as in claim 1, where the apparatus comprises a diaphragm connected to the coil, and where the diaphragm is connected to the frame, where the apparatus is a sound transducer;

at least one printed wiring board having the apparatus electrically connected thereto;

a processor connected to the at least one printed wiring board;

a memory comprising software connected to the at least one printed wiring board;

a camera connected to the at least one printed wiring board; and a battery connected to the at least one printed wiring board.

8. An apparatus as in claim 1 where the magnet pot is connected to the frame by a connection, where the frame is located both inside the magnet pot and outside the magnet pot for the connection to be an interlocking connection of the frame with the magnet pot.

9. An apparatus as in claim 1 where the first pole piece is a one-piece member.

10. An apparatus as in claim 1 where the first pole piece comprises a bottom portion and four spaced arms extending up from the bottom portion, where at least one of the arms have a general cross-sectional C shape.

11. An apparatus as in claim 1 where a cross sectional width of the magnet pot and the frame are substantially the same in at least one cross sectional location.

12. An apparatus comprising:

a frame;

a coil movably located in the apparatus; and a magnet system connected to the frame, where the magnet system comprises at least one magnet and at least one pole piece connected to the at least one magnet, where a first one of the at least one pole piece comprises a magnet pot, where a cross sectional length of the magnet pot and the frame are substantially the same in at least one cross sectional location, and where the frame is located against an interior lateral side of at least a portion of the first pole piece.

13. An apparatus comprising:

a frame; and a magnet pot connected to the frame by a connection, where the frame is located both inside the magnet pot and outside the magnet pot for the connection to be an i nterlocking connection of the frame with the magnet pot.

14. An apparatus as in claim 13 where a cross sectional length of the magnet pot and the frame are substantially the same in at least one cross sectional location.

15. An apparatus as in claim 13 where the frame is connected to the magnet pot by an insert mold formation of the frame onto the magnet pot.

16. An apparatus as in claim 13 where the magnet pot and the frame comprise substantially same cross sectional lengths in at least two orthogonal cross sectional locations.

17. An apparatus as in claim 13 where at least two sides of the magnet pot have a bend of more than 90 degrees.

18. An apparatus as in claim 13 where at least two sides of the magnet pot has an aperture therein, and where the frame extends through the aperture to interlock the frame with the magnet pot.

19. An apparatus as in claim 13 further comprising a coil movably located in the apparatus; and a magnet system connected to the frame, where the magnet system comprises at least one magnet and at least one pole piece connected to the at least one magnet, where the at least one pole piece comprises the magnet pot, and where a cross sectional length of the magnet pot and the frame are substantially the same in at least one cross sectional location.

* * * * *